US007053773B2

(12) United States Patent
McGarry et al.

(10) Patent No.: US 7,053,773 B2
(45) Date of Patent: May 30, 2006

(54) VENDING AUDIT SYSTEM

(75) Inventors: Patrick J. McGarry, Westchester, PA (US); Kevin L. Rabinovitch, Hacketstown, NJ (US); Cary M. Sagady, Chester Springs, PA (US); Darren L. Walker, Reading (GB)

(73) Assignee: Mars Incorporated, McLean, VA (US)

( * ) Notice: Subject to any disclaimer, the term of this patent is extended or adjusted under 35 U.S.C. 154(b) by 163 days.

(21) Appl. No.: 10/213,167

(22) Filed: Aug. 6, 2002

(65) Prior Publication Data

US 2003/0030539 A1 Feb. 13, 2003

Related U.S. Application Data

(60) Provisional application No. 60/310,573, filed on Aug. 7, 2001.

(51) Int. Cl.
*G08B 13/14* (2006.01)

(52) U.S. Cl. ..... 340/568.1; 340/572.1; 235/385

(58) Field of Classification Search ..... 340/568.1, 340/5.92, 572.1–572.9; 235/385, 381; 700/236, 700/232

See application file for complete search history.

(56) References Cited

U.S. PATENT DOCUMENTS

| | | | | |
|---|---|---|---|---|
| 3,656,145 | A * | 4/1972 | Proops | 340/310.02 |
| 4,766,548 | A * | 8/1988 | Cedrone et al. | 700/236 |
| 5,091,713 | A * | 2/1992 | Horne et al. | 340/541 |
| 5,207,784 | A * | 5/1993 | Schwartzendruber | 221/6 |
| 5,831,862 | A * | 11/1998 | Hetrick et al. | 700/232 |
| 5,963,136 | A | 10/1999 | O'Brien | 340/573.1 |
| 6,102,162 | A | 8/2000 | Teicher | 186/39 |
| 6,130,613 | A | 10/2000 | Eberhardt et al. | 340/572.7 |
| 6,181,981 | B1 * | 1/2001 | Varga et al. | 700/236 |
| 6,695,166 | B1 * | 2/2004 | Long | 221/14 |
| 6,753,830 | B1 * | 6/2004 | Gelbman | 345/55 |
| 2003/0006281 | A1 * | 1/2003 | Thomas et al. | 235/385 |

FOREIGN PATENT DOCUMENTS

WO WO 01/125034 A1 12/2001

* cited by examiner

*Primary Examiner*—Phung T. Nguyen
(74) *Attorney, Agent, or Firm*—Fish & Richardson P.C.

(57) ABSTRACT

A vend audit system and methods are described. In an implementation, the system includes vend items with packaging having tags, at least one tag sensor, and a control circuit capable of receiving data from the tag sensor. A method for tracking inventory in a vending machine is also described. In an implementation, the technique includes loading vend items having tags into a vending machine, sensing the tags, and transferring information to a control circuit. The tags may be RF tags, and the tag sensor may be an RF antenna sensor.

7 Claims, 3 Drawing Sheets

VENDING AUDIT SYSTEM

This application claims priority from U.S. Provisional Application Ser. No. 60/310,573 filed on Aug. 7, 2001.

BACKGROUND OF THE INVENTION

The present invention relates generally to a system for tracking items that have been loaded into a vending machine.

The vending industry has traditionally lacked tight controls on product inventory movement both in and out of the vending machine. A route person often loads vending machine dispensing locations with whatever items match the price corresponding to a location. Consequently, the route person sometimes mixes varieties or types of snack category items. For example, packets of pretzels, potato chips and cheese snacks may all cost the same amount of money and may be loaded into one dispensing location, which may be a helix-type dispenser in a glass-front vending machine. Vending machine operators prefer that each dispensing location in a glass-front vending machine contain only one type of product so that the overall display of products presents an easily understandable and neat appearance to consumers.

In glass front vending machines that include helix or spiral-type dispensers, occasionally a product fails to exit the spiral when vending, thus cheating the consumer. This sometimes also occurs in vending machines having other types of product delivery mechanisms. The route person or owner often does not become aware of the problem until the next scheduled visit to the vending machine. Consumers cheated in such a manner sometimes physically jostle the machine in an attempt to dislodge the product, which sometimes damages the vending machine.

Vending machine owners also usually have no knowledge of the exact inventory loaded into a vending machine. The total inventory loaded into the machine could be recorded on hand-held computers by a route person via the infrared scanning of SKUs, but this rarely, if ever, occurs. An SKU is an item number or identifier associated with a particular product and manufacturer.

Other industries have used Automatic Identification and Data Capture (AIDC) technologies to increase the efficiency of business processes, to reduce manual labor and to improve the integrity of gathered data. These technologies have included bar code, machine vision devices, other optical systems and mechanical and inductive flags. Manufacturers, particularly in supply chain and logistics areas, have also used Radio Frequency Identification (RFID) tags. While RFID tag systems have held the promise of improving upon the benefits of bar code systems, the RFID systems have not yet reached a level of affordability to achieve widespread adoption.

Conventional RFID tags work on an inductive principle. In an inductive RFID system, a reader generates a magnetic field at a predetermined frequency. When a tag enters the field, a small electric current forms in the tag's "resonant tank circuit", which consists of a coil and a capacitor. The resonant tank circuit provides power to an RFID chip in the tag which then modulates the magnetic field and transmits preprogrammed data back to the reader. The reader receives the signal transmission, demodulates and decodes it, and sends the data on to a host computer for further processing.

RFID systems and tags come in many different configurations. RFID tags are typically more expensive than bar code labels, and prices may reach up to $200 for a battery-powered read/write tag. But such read/write tags have unique features and attributes that can lower the overall system cost. Inexpensive RFID tags, sometimes called "button" tags have been developed that cost on the order of $1.00 per unit. However, the button tags are passive, meaning that they do not include a power source, and are thus more limited functionally. However, all RFID systems can potentially improve operating efficiencies, eliminate human error, and speed system throughput through automatic passive data capture. In addition, RFID systems provide the added benefit of being less costly to maintain than a bar code automated identification system.

There is a need for an inexpensive and robust system for tracking the number of products in any given dispensing location of a vending machine, and for communicating such information to a vending machine operator so that inventory replenishment and/or service visits can be schedule. It would be advantageous to have a system that standardizes the electronic encoding of packages so that inventory information, and failed dispensing of product reports could be automatically transmitted to vending machine operators.

SUMMARY OF THE INVENTION

Presented is a vend audit system and techniques for using such a system. In an implementation, the vend audit system includes vend items with packaging having at least one tag, at least one tag sensor, and a control circuit capable of receiving data from the tag sensor.

The vend audit system may include one or more of the following features. The tag may be a printed radio-frequency (RF) smart-tag, and the tag sensor may be an RF antenna associated with a product dispenser. The system may further include a communications device for transferring data concerning the vend items to a central office.

Another aspect of the invention concerns a package. The package includes a first layer of material for wrapping a vend item, at least one further layer of packaging material for overlaying the first layer, and a radio-frequency (RF) tag printed on at least one surface of at least one of the first and further layers.

In yet another aspect of the invention, a method for tracking inventory in a vending machine is disclosed. The method includes loading vend items having tags into a vending machine, sensing the tags with at least one tag sensor, and transferring information concerning the vend items to a control circuit.

This aspect of the invention may include one or more of the following features. The tags may be printed radio-frequency (RF) tags, and the tag sensor is an RF sensor. The method may include transferring information concerning the vend items to a central office. The information may include whether a vend item has successfully exited a product dispenser. The information may also include at least one of use-by date data, brand identity data, planogram data and SKU data. The method may also include at least one of disabling the vending machine and alerting service personnel, depending on brand identity data of at least one vend item. The method may further include at least one of lowering a vend item price and preventing sale of a vend item, depending on use-by date data of the vend item. The method may also include at least one of sensing service personnel RF tags, sensing customer RF tags, and at least one of generating an alarm signal, notifying a central office and authorizing a customer payment.

A method of preparing a package is yet a further aspect of the invention. The method includes preparing a first layer of packaging material for wrapping a vend item, preparing at least one further layer of packaging material to overlay the first layer, and printing a radio-frequency (RF) tag on at least one surface of at least one of the first and further layers.

This method may include one or more of the following features. The RF tag may be printed on an outside surface of the first layer of packaging. The RF tag may be printed on an inside surface of at least one of the further layers of packaging.

Other modifications and advantages of the invention will be readily apparent from the attached figures and the detailed description below.

DETAILED DESCRIPTION

Figure 1:
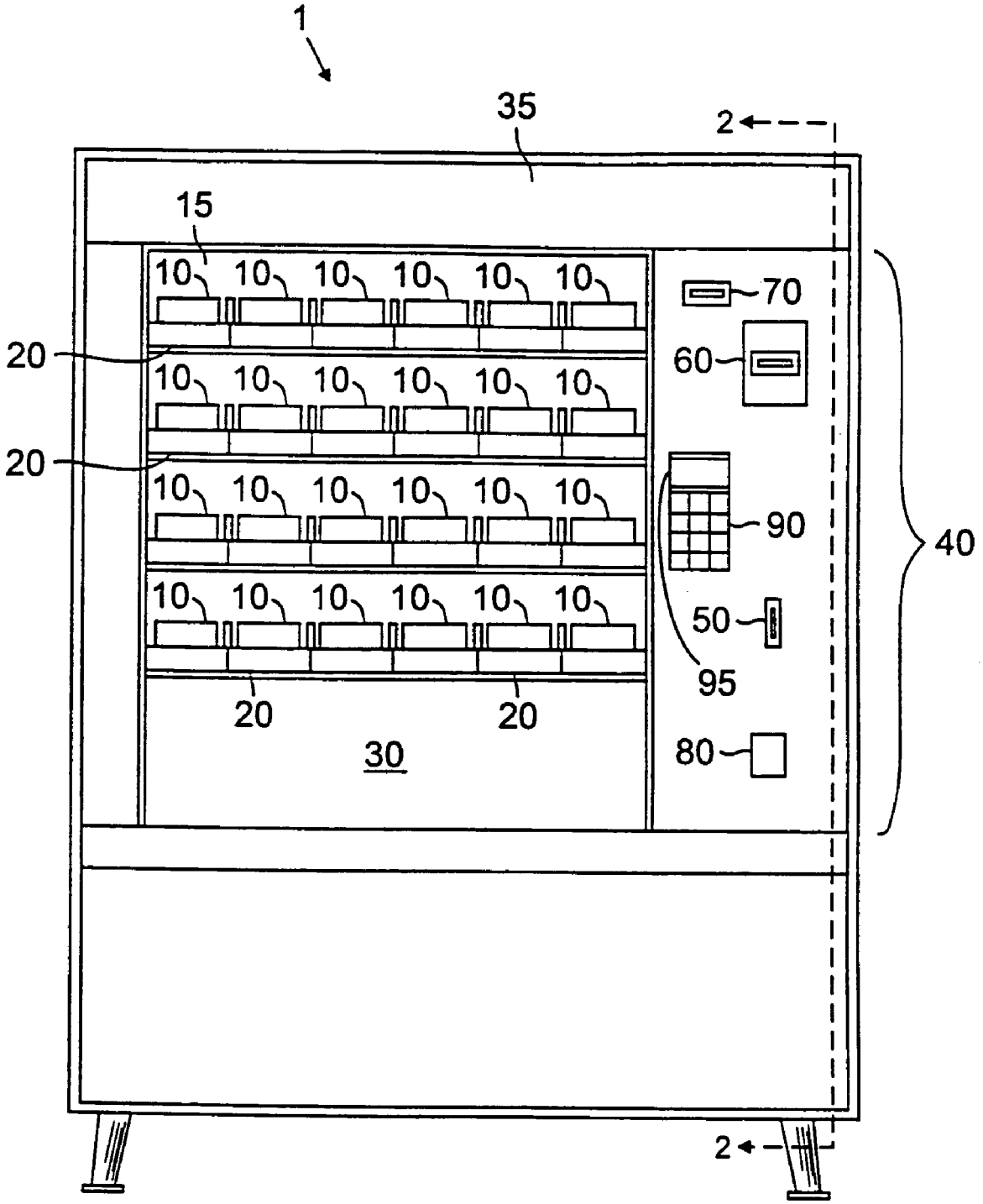
FIG. 1 is a front view of an implementation of a vending machine system adapted to track items according to the invention.

FIG. 1 is a simplified drawing of a vending machine 1 that is capable of accepting a plurality of payment means in exchange for a product. The term "vending machine", as used herein, refers to any automatic transaction machine that can dispense products such as snacks or beverages, money, receipts, coupons, certificates, discount cards, ID cards, or other goods, or provide services. In particular, the vending machine 1 may be a glass-front machine having helix-type dispensers, and adapted to accept various forms of currency such as coupons, coins, banknotes or bills, security documents, credit or debit cards and electronic purse devices. The term "electronic purse device" used herein denotes a token or card possessing an electronic circuit, a magnetic strip or other data storing medium or circuitry, for retaining a credit value equivalent to money. It should also be understood that like components in the figures have been numbered the same throughout for ease of reference.

In the implementation shown, a variety of products 10 to be dispensed are stored in a display area 15 inaccessible to customers, such as behind a transparent glass panel. Each product 10 is retained by a separate product-delivery apparatus 20 that may be a helix-type dispenser. Each product dispenser 20 is selectively actuatable by a customer to dispense the product into a delivery area 30 from which the customer can retrieve the selected product. For example, a consumer may select a particular product by selecting a particular dispenser 20 by using a keypad 90.

The front panel 35 of the vending machine 1 has a control panel 40 having a coin slot 50, an entryway 60, and a card opening 70. The card opening 70 may accept various forms of payment such as a coupon, an electronic purse device, a credit card, or a debit card. The control panel 40 also contains a coin return 80 and an item selector such as a keypad 90. A display 95 may provide instructions and other information to a customer. A customer initiates a transaction by depositing coins or bills of particular denominations, into respective openings 50 or 60 along the control panel 40 in payment for an item. A customer may also insert a coupon, an electronic purse device, or a debit or credit card into entryway 60 or card opening 70 to initiate a transaction. Once sufficient payment has been deposited, the customer may select a product 10 to be dispensed using the keypad 90. The corresponding product delivery apparatus 20 will then dispense the selected product 10 to the product delivery area 30 where it can be retrieved by the customer. Any change resulting from the transaction may be paid back to the customer through the coin return opening 80 or be credited by a card reader to an inserted electronic purse device. Details concerning money validation, card validation, establishing credit, dispensing products, paying out change, and other such vending machine functions are beyond the scope of this application and thus will not be discussed herein.

Figure 2:
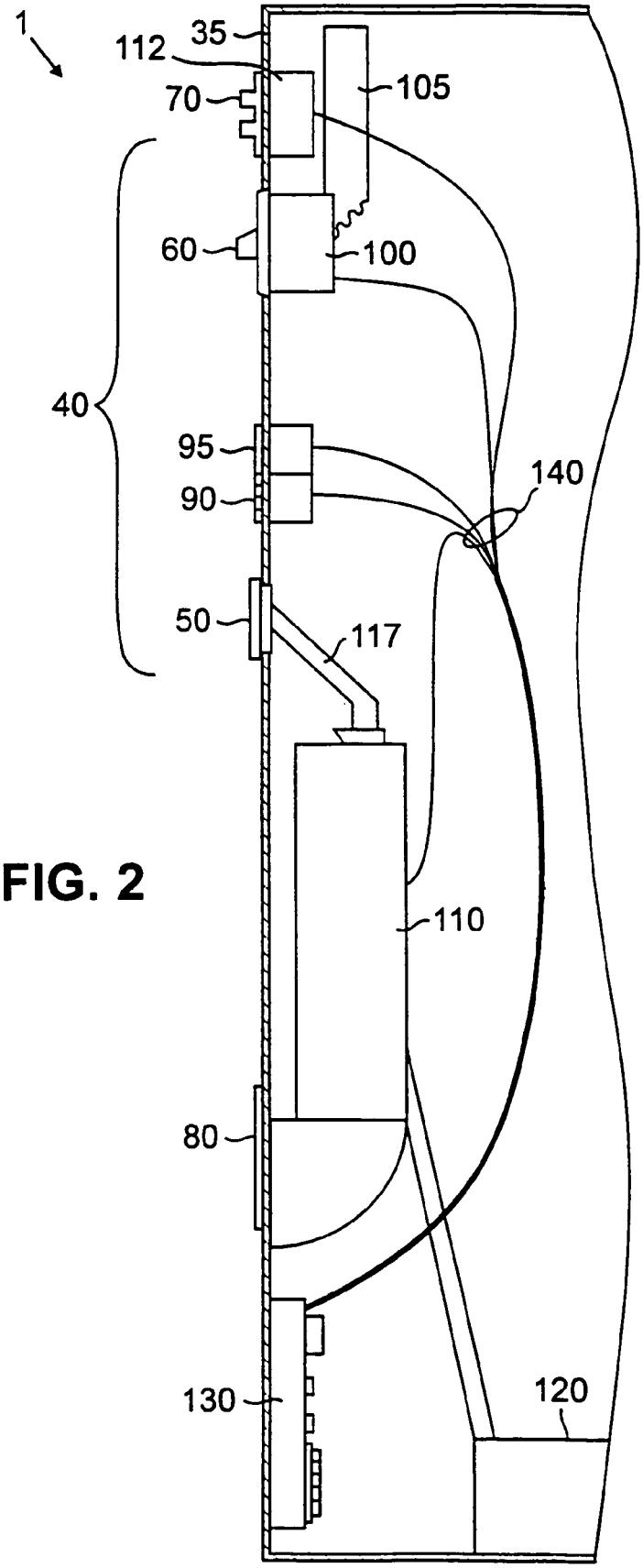
FIG. 2 is a cutaway side view of the vending machine system of FIG. 1.

FIG. 2 is an enlarged, cutaway side view along dotted line 2—2 of FIG. 1 that illustrates the layout of typical internal components of the vending machine. In particular, connected to the rear of the control panel 40 are a bill validator 100, which is aligned with the entryway 60, a coin mechanism 110 connected to the coin slot 50 via coin passageway 117, and a card reader 112 aligned with the card opening 70. The coin mechanism 110 is also attached to the coin return 80, and to a coin box 120. The bill validator 100 is also attached to a stacker 105. A keypad 90 and display 95 are also connected to the control panel 40, and are electronically connected via lines 140 to a vending controller or computer 130. The card reader 112, bill validator 100, and coin validator 110 are also electronically connected to the vending controller 130. It will be understood by those of skill in the art that the connection of the payment devices shown in FIGS. 1 and 2 to the vending machine front panel 35, and the electronic connections to the vending controller 130 are merely illustrative. Many other configurations may be used.

Recent advances in inorganic compounds allow for the printing of semiconductor materials in a 10–20 micron layer with an ink-jet type printing device. It is contemplated that this technology can be used to print semiconductor circuits, such as transistors and the like, on product packaging, on various product labels, and perhaps on beverage containers. The circuits can be configured as a passive RF tag, and such simple versions of a smart-tag can be included with an individual product packaging at a sub-penny unit price (in the order of $0.001). The components permit printing of RF tags having 8–10 bits of data which can be encoded to cover 1000 unique SKU equivalents on the packaging. Specifically, laminated packaging would allow for such printed smart-tag devices to be kept isolated from the product they protect.

An RF identification system provides a number of benefits over bar code systems. In particular, because bar code systems are optical, obscuring of the label (or of the bar code reader lens) by exposure to dirt, dust, water, ink or paint makes the label unreadable. With an RF identification tag, there are no such optical considerations. RFID tags may be read through nonmetallic coatings of dirt, dust, paint and the like without a decrease in performance.

Figure 3:
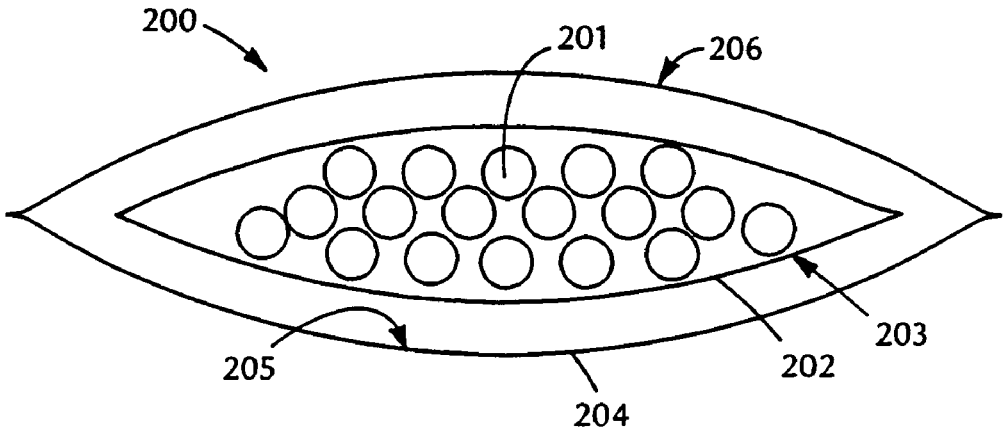
FIG. 3 is a simplified cross-sectional view of a layered product package of a type suitable for use in a system according to the invention.

FIG. 3 is a simplified cross-sectional view of a layered product package 200 containing edible items 201. The package includes an inner layer 202 designed to keep the product 201 fresh, and an outer layer 204. The outer layer typically includes the product name, logo, written description, nutritional information and the like printed on the outside surface 206. It is contemplated that a semiconductor smart-tag may be printed on the outside surface 203 of the inner layer 202 so as not to contact the edible items 201, or on the inner surface 205 of the outer layer 204. If the smart-tag is printed on either surface 203 or 205, then it would not be visible to a consumer, and would not interfere with the edible items or the information printed on the outside surface of the outer layer. However, the RF tag may also be printed on the outside layer surface 206 of the package 200.

In order to read the smart-tag, the vending machine must include at least one sensing device and processing circuitry. The RF tag characteristics may be read with a strong radio-frequency (RF) field. For example, in the spiral type snack machine of FIG. 1, each spiral of each of the dispensers 20 may be configured as an antenna that emits an excitation or oscillating field and receives signals. The signals from each antenna may be converted to digital signals for processing by a vending machine controller. In an implementation, a group of products in a particular spiral dispenser generate a signature signal that is different from that generated by other products loaded into other dispensers. These signature signals can be used to determine if each spiral dispenser of a vending machine is loaded with the correct brand and quantity of product. In addition, a vending machine operator will be able to acquire inventory data for a particular vending machine.

It should also be understood that the RF tag could be printed on a label for attachment to a product. For example, the RF tag could be printed on an inner surface of a label that is then attached to a beverage bottle and loaded into a vending machine.

The product information received from the RF smart-tags printed on the packages may be encoded by electronics in the vending machine controller 130 into Digital Exchange ("DEX") audit data, enabling a high degree of accuracy for product accountability. DEX is a data standard that is adhered to by some vending machine manufacturers. Handheld devices or telemeters communicate the DEX data to a software host system that monitors, among other things, product depletion. It should be understood, however, that other data communication techniques could be used.

The additional problem of product failing to exit the vending machine may be addressed in either of two ways. First, by looking at the signature of a particular dispensing spiral, it can be determined if the item fell after one turn. Alternately, a sensor at the product exit point could measure the passage of the package by sensing the associated RF smart-tag. A failure can be corrected by continuing to rotate the spiral past a nominal park point. In other types of dispensing systems, a sensor or sensors may be placed to enable the vending machine controller to determine if a product exited the dispenser correctly.

Figure 4:
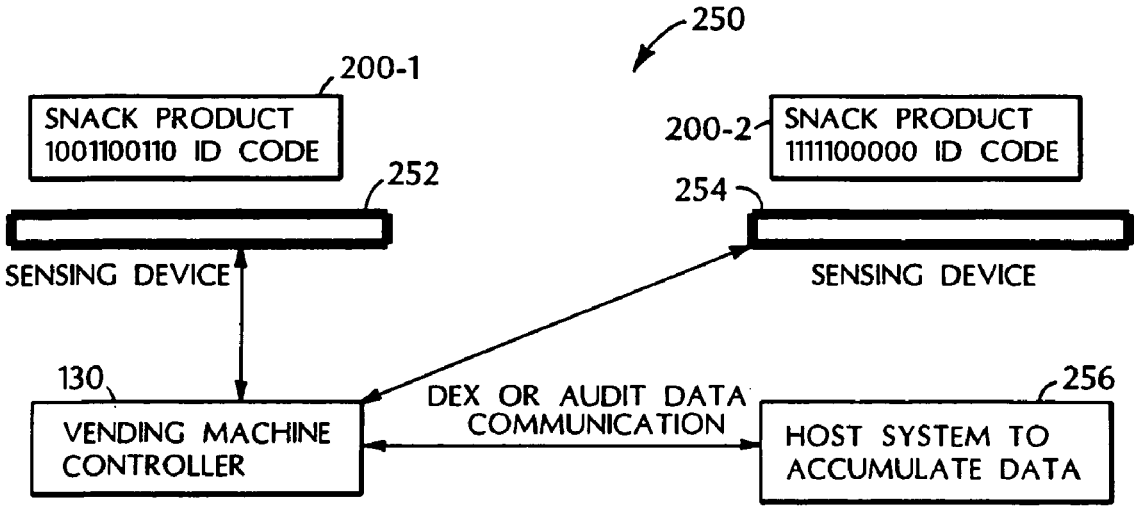
FIG. 4 is a simplified block diagram of a vending audit system according to the invention.

FIG. 4 is a simplified block diagram of a vending audit system 250. The implementation shown includes a plurality of sensing devices 252, 254 that communicate with a vending machine controller (VMC) 130. The VMC may be configured to communicate by DEX or by another audit data standard to a host system 256. The host system 256 may be a computer server or other data processing device running audit software at a central office. A vending machine operator could then monitor the data received from this vending machine, and other vending machines, to track inventory, to determine if a vend has failed, and to ensure that each dispenser 20 of a particular vending machine includes product items of the same type.

The system can be incorporated into a new machine design or retrofit to existing vending machines. The communications between the vending machine controller and the sensing devices may be conducted through wired or wireless connections. In addition, the VMC may communicate with the host system via an Internet connection, an intranet connection, a telephonic connection, an Ethernet connection, a fiber optic connection, a modem, or via a wireless device. Alternately, data could be extracted from the VMC by a handheld or telemetry device for communication with the host system.

RF smart-tags may be used to perform other vending machine functions in addition to measuring fill levels of a vending machine and monitoring for failure of a product to exit the vending machine. For example, RF tags could be applied to products, such as various food items, that have a limited life. A "use-by" date could be incorporated into the data of the RF tag and used to alert a vending machine operator when the item is approaching the expiration date. The "use-by" date data could also trigger other functions. For example, when the product is within seven (7) days of its expiration date, the VMC could reduce the price of the product to encourage a consumer to buy it. In addition, when the expiration date is reached, the VMC could prevent the sale of the product and alert service personnel to remove the product. The RF tags could also be used for brand control and level monitoring by item SKU. For example, in a branded vending machine that sells products of a particular company, all authorized products contain RF tags with identifying data so that counterfeit or renegade products will not be dispensed. If a renegade product were to be found, the VMC could disable the vending machine and trigger an alarm that is transmitted to the vending machine operator. Service personnel can then be dispatched from a central office to remove those products.

The RF tags could also be used to determine if the product mix in a particular vending machine is correct. For example, a planogram or map of products 10 that should be in each product delivery apparatus 20 (see FIG. 1) could be generated. When a route person loads the machine, the RF tags for each product could be checked by the VMC against the planogram for violations. If products have been loaded incorrectly, or if renegade products have been loaded, the central office could be notified and the VMC could disable the machine until the situation is corrected.

One or more RF sensing devices resident in the vending machine could be used to recognize route personnel and/or maintenance personnel and/or service personnel to help prevent fraud. For example, service personnel could have RF tag identifiers sewn into their uniforms. When the lock on the vending machine cabinet door is being opened, the VMC could have an RF sensing device check for the identifying data of the service person. If not found, a local alarm could be engaged and notification sent to the central office and/or to the vending machine operator. The RF sensing devices in the vending machine can also be used to recognize other things, such as particular machine components, different cash-boxes, and the like. It may also be possible for an RF sensing device to recognize an RFID smart-tag in the possession of a consumer and authorize a cashless payment for a product. In such a case the VMC may function to authorize a vend and may signal a central office to debit the consumers account for the transaction.

Although several embodiments of the invention have been described, modifications, alternatives and variations will be apparent to those skilled in the art. For example, an alternate embodiment of a vend audit system may include vend items that include packaging having printed radio-frequency (RF) smart-tags, at least one RF sensor, and a control circuit capable of receiving data from the RF sensor concerning the vend items. The control circuit and at least one sensor may be part of a retrofit kit for installation in existing vending machines. In addition, the system may include a communications device for transferring data concerning the vend items to a central office. The communications device may include a wireless device, or a wired device, or a portable unit for use by a route person, to transfer data concerning vend items from the control circuit to a central office. Accordingly, such modifications, alterations and variations are within the scope of the appended claims.

What is claimed is:

1. A method for tracking inventory in a vending machine comprising:

dispensing a vend item from a vending machine, wherein a radio-frequency (RF) tag is attached to the dispensed vend item;

using a sensor to sense the RF tag attached to the vend item so as to check passage of the dispensed vend item past an exit point; and transferring information concerning the vend item to a control circuit, wherein said information includes whether the vend item has successfully exited a product dispenser.

2. The method of claim 1 wherein the tag is a printed RF tag.

3. The method of claim 1 further comprising transferring information concerning the vend item to a central office.

4. The method of claim 1 wherein the information includes at least one of use-by date data, brand identity data, planogram data and SKU data.

5. The method of claim 1 further comprising at least one of generating an alarm signal, notifying a central office and authorizing a customer payment.

6. The method of claim 1 wherein the vend item has a first layer of packaging material wrapped about the vend item and at least one further layer of packaging material that overlays the first layer, wherein the RF tag is printed on an outside surface of the first layer of packaging material.

7. The method of claim 1 wherein the vend item has a first layer of packaging material wrapped about the vend item and at least one further layer of packaging material that overlays the first layer, wherein the RF tag is printed on an inside surface of one of the further layers of packaging material.

* * * * *